US007413055B2

(12) United States Patent
Kawasaki et al.

(10) Patent No.: US 7,413,055 B2
(45) Date of Patent: Aug. 19, 2008

(54) ELEVATOR

(75) Inventors: Kan Kawasaki, Tokyo (JP); Ikuo Asami, Saitama-ken (JP); Takashi Ishii, Chiba-ken (JP); Kazuaki Miyakoshi, Kanagawa-ken (JP); Masahiro Kuramitsu, Saitama-ken (JP); Kazuhiro Izumi, Tokyo (JP); Hiroshi Sano, Tokyo (JP); Shigeru Takaishi, Tokyo (JP); Shun Fujimura, Tokyo (JP); Takanori Urata, Tokyo (JP); Satoshi Takasawa, Tokyo (JP); Masayuki Higashi, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 551 days.

(21) Appl. No.: 10/508,550

(22) PCT Filed: Feb. 3, 2004

(86) PCT No.: PCT/JP2004/001032

§ 371 (c)(1),
(2), (4) Date: Apr. 11, 2005

(87) PCT Pub. No.: WO2004/069718

PCT Pub. Date: Aug. 19, 2004

(65) Prior Publication Data

US 2005/0178621 A1 Aug. 18, 2005

(30) Foreign Application Priority Data

Feb. 4, 2003 (JP) ..... 2003-027418

(51) Int. Cl.
*B66B 7/06* (2006.01)
*B66B 11/00* (2006.01)

(52) U.S. Cl. ..... 187/266; 187/408; 187/414

(58) Field of Classification Search ..... 187/287, 187/254, 266, 373, 408, 414
See application file for complete search history.

(56) References Cited

U.S. PATENT DOCUMENTS 6,360,847 B1 * 3/2002 Okada et al. ..... 187/373

(Continued)

FOREIGN PATENT DOCUMENTS

JP 8-175776 7/1996

(Continued)

OTHER PUBLICATIONS

U.S. Appl. No. 10/508,550, filed Apr. 11, 2005, Kawasaki et al.

(Continued)

*Primary Examiner*—Lincoln Donovan
*Assistant Examiner*—Eduardo Colon
(74) *Attorney, Agent, or Firm*—Oblon, Spivak, McClelland, Maier & Neustadt, P.C.

(57) ABSTRACT

In an elevator, a drive device, a traction sheave, and a weight-side stop portion are arranged above one of a pair of left and right cage-side guide rails, and a cage-side stop portion and speed governor are arranged above the other cage-side guide rail. A wide workspace is realized in the middle of the floor of the machinery chamber, since the control panel is arranged along the middle of the inside wall surface of the front face of the machinery chamber. Furthermore, provision of an additional supporting beam mounted in the building is unnecessary, since the machine beam can extend fully in the forwards/rearwards direction in the interior of the machinery chamber.

14 Claims, 12 Drawing Sheets

U.S. PATENT DOCUMENTS

| | | | | |
|---|---|---|---|---|
| 2007/0175707 | A1* | 8/2007 | Ishii et al. | 187/287 |
| 2007/0181376 | A1* | 8/2007 | Henneau et al. | 187/293 |

FOREIGN PATENT DOCUMENTS

| | | | | |
|---|---|---|---|---|
| JP | 11-79624 | | | 3/1999 |
| JP | 11071069 | A | * | 3/1999 |
| JP | 2000-153973 | | | 6/2000 |
| JP | 2001-48445 | | | 2/2001 |
| JP | 2001048441 | A | * | 2/2001 |
| JP | 2001-72351 | | | 3/2001 |
| JP | 2001-187678 | | | 7/2001 |
| JP | 2001335255 | A | * | 12/2001 |
| JP | 2002-179355 | | | 6/2002 |
| JP | 2004238128 | A | * | 8/2004 |

OTHER PUBLICATIONS

U.S. Appl. No. 10/528,815, filed Mar. 23, 2005, Ishii et al.
U.S. Appl. No. 10/548,947, filed Sep. 15, 2005, Ishii et al.
U.S. Appl. No. 11/597,906, filed Nov. 29, 2006, Kawasaki et al.

* cited by examiner

ELEVATOR

TECHNICAL FIELD

The present invention relates to an elevator and more particularly relates to an elevator provided with a machinery chamber (sometimes this is called a machine room) which is of equivalent area to the horizontal cross-section of the elevator shaft (elevator hoistway or ascending/descending path, sometimes simply called the shaft) yet in which the working space necessary for maintenance and inspection of the hoisting machine or control panel and speed governor (sometimes simply called governor) and the like can be enlarged, and wherein there is no need to add a supporting beam in the building in order to install the hoisting machine.

TECHNICAL BACKGROUND

Conventionally, as disclosed in Laid-open Japanese Patent Publication No. H. 8-175776 (FIG. 6 and FIG. 7), a machinery chamber is provided above the elevator shaft whereby the elevator cage (cage) and/or counterweight (balancing weight) and the like ascend and descend and the hoisting machine and/or control panel and speed governor and the like are provided within this.

For example, in the machinery chamber 1 of the conventional elevator shown in FIG. 1, a hoisting machine 2 is arranged in the center, a control panel 3 is arranged along the left side wall 1*a* and a speed governor 4 is arranged along the rear wall 1*b*, respectively.

The cage and counterweight, not shown, are suspended in the manner of an elevator cage by means of a main rope 5 that passes over a traction sheave 2*a* and a deflector sheave 2*b* that are driven in rotation by the hoisting machine 2.

In addition, a machine bed 6 on which the hoisting machine 2 is placed is supported by means of anti-vibration rubber elements 7*a*, 7*b* on a total of three machine beams 8 that extend horizontally in the left and right directions of the drawing.

Also, these machine beams 8 are supported by means of supporting beams 10*a*, 10*b* mounted in the building and extending in the direction perpendicular to the plane of the drawing, by means of level-raising machine beams 9*a*, 9*b*, as illustrated in for example Laid-open Japanese Patent Publication No. H. 11-79624 (FIG. 7).

In the case of the conventional elevator shown in FIG. 1, the hoisting machine 2 is arranged in the middle of the machinery chamber 1 for convenience in suspending the elevator cage and the counterweight.

In this way, the working space needed for maintenance and inspection of the hoisting machine 2 and control panel 3 and speed governor 4 and the like is disposed so as to surround the hoisting machine 2; however, it is still possible to ensure sufficient width necessary for performing the maintenance and inspection tasks.

However, the laws relating to buildings and the standards etc relating to ensuring safety of elevators are different in Japan and foreign countries and in some countries it is obligatory to guarantee a total working space in the machinery chamber of width providing more than a certain fixed area for purposes of maintenance and inspection. It is of course obligatory on the applicant to observe the law of the country in which the application is made.

In this case, if the working space is arranged so as to surround the hoisting machine 2, the safety standards of this country cannot be satisfied, so it is necessary to provide a machinery chamber of a floor area larger than the horizontal cross-sectional dimension of the elevator shaft.

Furthermore, in the case of the conventional elevator shown in FIG. 1, it is necessary to arrange the control panel 3 on the line of extension of a machine beam 8, for reasons to do with the layout in the machinery chamber 1.

Consequently, if it is not possible to extend the tips of the machine beams 8 to the supporting beam 10*c* that is mounted on the building and is below the left-hand wall 1*a*, a supporting beam 10*a* mounted on the building must be added.

Alternatively, as shown in FIG. 2, if the tips of the machine beams 8 were to be extended as far as the supporting beam 10*c* that is mounted on the building and is below the wall 1*a* on the left-hand side, it would be necessary for the control panel 3 to be mounted on a machine beam 8 and a working platform 11 to be arranged so as to guarantee a workspace for maintenance and inspection of the control panel 3.

In this case, it may sometimes be necessary to restrict the dimension in the height direction of the control panel 3 so that the top of the control panel 3 does not interfere with the ceiling portion of the machinery chamber 1.

However, as can be seen from FIG. 2, arranging the hoisting machine in substantially the middle of the machinery chamber for reasons to do with the mechanical construction and, accompanying such arrangement of the hoisting machine in the middle, arranging the control panel etc at the periphery of the machinery chamber was in fact the conventional arrangement. However, as explained above, this made it impossible to observe the standard for elevator installation of the country in question.

SUMMARY OF THE INVENTION

Accordingly, an object of the present invention is to provide an elevator whereby the problems of the prior art described above are solved and that is provided with a machinery chamber in which a sufficient workspace necessary for maintenance and inspection of the hoisting machine and control panel and speed governor and the like can be obtained while yet having an area that is equivalent to the horizontal cross-section of the elevator shaft and wherein there is no need to add a supporting beam mounted on the building in order to install the hoisting machine.

In order to achieve the above object, in an elevator according to the present invention, the hoisting machine, control panel, speed governor and stop portion of the wire rope are arranged respectively along the inside wall surface of the machinery chamber and the workspace for maintenance and inspection of these items of equipment is provided in the central portion of the machinery chamber.

In order to achieve the above object, an elevator according to the present invention comprises:

a hoisting machine for raising and lowering the cage;

a wire rope for raising and lowering the cage by means of the hoisting machine;

a control panel that controls drive of the hoisting machine;

a speed governor that checks whether the cage is ascending or descending with appropriate speed;

a wire rope stop portion (a wire rope hitch) that abuts one end of the wire rope; and a machinery chamber in which the hoisting machine, control panel, speed governor and wire rope stop portion are arranged in the chamber; wherein the hoisting machine, control panel, speed governor and stop portion of the wire rope are arranged along the inside wall surface of the machinery chamber and the space for maintenance and inspection of all these items of equipment is provided in the central portion of the machinery chamber.

Specifically, with an elevator according to the present invention, the workspace for maintenance and inspection of all of these can be arranged in the middle of the machinery chamber, so, even though the machinery chamber is of a floor area equivalent to the horizontal cross-section of the elevator shaft, the safety standards for guaranteeing a workspace of at least a certain fixed area can be satisfied.

Also, an elevator according to the present invention comprises a cage that ascends and descends within an elevator shaft guided on a pair of left and right cage-side guide rails and a traction sheave that rotates about an axis of rotation extending in the forwards/rearwards direction and arranged above one of other of the pair of left and right guide rails on the cage side;

a drive device having an axis that extends in the forwards/rearwards direction and that drives the traction sheave in rotation;

a counterweight (balancing weight) that ascends and descends within the elevator shaft while being guided on a pair of front and rear weight-side guide rails below the traction sheave;

a cage-side sheave provided on the cage; and a wire rope wound onto the traction sheave and whereof one end thereof suspends the cage by means of the cage-side sheave and the other end thereof suspends the counterweight.

Also, in regard to the machinery chamber that is provided above the elevator shaft, a machine beam that extends in the forwards/rearwards direction between supporting beams mounted on the building along one inside wall surface of the pair of left and right inside wall surfaces that extend in the forwards/rearwards direction facing each other supports the drive device and the traction sheave and the weight-side stop portion that abuts the end of the wire rope on the counterweight side; and a speed governor and cage-side stop portion that abuts the end of the wire rope on the cage side are arranged along the other inside wall surface of the left and right pair of inside wall surfaces, and, furthermore, a control panel that controls the operation of the drive device is arranged along the other inside wall surface or along an inside wall surface extending in the left/right direction between the pair of left and right inside wall surfaces.

That is, in an elevator according to the present invention, a drive device, traction sheave and weight-side stop portion can be arranged above one of a pair of left and right cage-side guide rails and the cage-side stop portion and speed governor can be arranged above the other thereof.

In this way, of the pair of left and right inside wall surfaces of the machinery chamber, the drive device, traction sheave and weight-side stop portion can be arranged along for example the left inside wall surface and the cage-side stop portion and the speed governor arranged along the right-side inside wall surface.

Also, the control panel that controls the operation of the drive device etc can be arranged along the right inside wall surface or arranged along the inside wall surface of the front face or the rear face.

Consequently, since all of the workspace for maintenance and inspection can be arranged in the middle portion of the machinery chamber, even in the case of a machinery chamber of floor area equivalent to the cross-sectional area of the elevator shaft, the safety standards for ensuring a workspace of at least a certain fixed area can be satisfied.

Furthermore, since the machine beam that supports the drive device, traction sheave and weight-side stop portion can extend in the forwards/rearwards direction between supporting beams mounted on the building along the right inside wall surface without interfering with the cage-side stop portion, speed governor or control panel, there is no need for the additional provision of a beam mounted on the building for supporting the machine beam.

Also, in an elevator according to the present invention, the cage-side stop portion and speed governor are both arranged on the side remote from the front-face inside wall surface, of the other inside wall surface.

Specifically, in an elevator according to the present invention, free space appears in the portion adjacent the inside wall surface on the front-face side, of the other inside wall surfaces of the machinery chamber, so a machinery chamber door can for example also be provided there or the control panel can also be arranged there.

Also, in an elevator according to the present invention, the cage side stop portion is provided on a support beam that extends in the forwards/rearwards direction between supporting beams mounted on the building, along another inside wall surface.

Specifically, in an elevator according to the present invention, the cage-side stop portion can be firmly supported by a support beam extending in the forwards/rearwards direction spanning a pair of supporting beams mounted on the building that extend in the left/right direction along the two front and rear sides of the machinery chamber.

Also, in an elevator according to the present invention, the cage-side stop portion is provided on a support beam that extends in the left/right direction to the machine beam from the supporting beam mounted on the building that extends in the forwards/rearwards direction along the other inside wall surface.

Specifically, in an elevator according to the present invention, the cage-side stop portion can be firmly supported by means of a support beam extending in the left/right direction spanning the machine beam and one of a pair of supporting beams mounted on the building that extend in the forwards/rearwards direction along the two left and right sides of the machinery chamber.

Also, in an elevator according to the present invention, the speed governor is provided above the cage-side stop portion.

That is, in an elevator according to the present invention, the cage-side stop portion and the speed governor are mutually adjacently arranged, but the speed governor is provided at a position higher than the cage-side stop portion, so the task of maintenance and inspection of the speed governor can be performed without interference from the cage-side stop portion.

Also, in an elevator according to the present invention, the control panel is arranged in a position that does not interfere with the support beam.

Specifically, in an elevator according to the present invention, the cage-side stop portion is provided on the support beam, but, since the control panel is provided in a position that does not interfere with this support beam, the task of maintenance and inspection of the control panel can be performed without being obstructed by the support beam.

Also in an elevator according to the present invention the control panel is placed on the support beam.

Specifically, in an elevator according to the present invention, the cage-side stop portion is provided on the support beam, but, since the control panel is provided on this support beam, the task of maintenance and inspection of the control panel can be performed without being obstructed by the support beam.

Also, in an elevator according to the present invention, the cage-side sheave is a cage-side sheave of a pair of left and right cage-side sheaves that are respectively arranged in the vicinity of the left and right side walls of the cage.

Specifically, in an elevator according to the present invention, the pair of left and right cage-side sheaves can be fully separated as far as possible in the left/right direction, so the interval in the left/right direction between the traction sheave and the cage-side stop portion in the interior of the machinery chamber can be made wider, making it possible to obtain a large workspace in the interior of the machinery chamber.

Also, in an elevator according to the present invention, the traction sheave, when viewed from vertically above, is arranged such that at least part thereof overlaps the cage.

Specifically, with an elevator according to the present invention, a cage-side sheave can be arranged directly below one or other of left and right traction sheaves. In addition, the counterweight is arranged directly below one or other of the left and right traction sheaves.

In this way, since the angle of winding-on of the wire rope with respect to the traction sheave can be made 180° or more, reliable transmission of the pulling-up force to the wire rope from the traction sheave can be achieved by ensuring fully satisfactory traction performance.

Also, in an elevator according to the present invention, the dimension of the drive device in the axial direction (or the axial line direction) is larger than its external dimension.

Specifically, if a small diameter rope of external diameter for example 4 to 6 mm is adopted as the wire rope, the external diameter of the cage-side sheave and the traction sheave can be kept small, making it possible to increase the degree of freedom of arrangement of the sheaves.

Also, if the external diameter of the traction sheave is made small, it is possible to use a direct drive motor with a small-diameter long shaft and high rotational speed as the drive device.

In this way, the space in the left/right direction occupied by the drive device in the interior of the machinery chamber can be reduced, so the workspace in the interior of the machinery chamber can be increased in the left/right direction.

BEST MODE FOR PUTTING THE INVENTION INTO PRACTICE

Embodiments of an elevator according to the present invention are described in detail below with reference to FIG. 3 to FIG. 14.

It should be noted that, in the following description, the direction in which the doors of the cage open and close is termed the left/right direction, the direction in which passengers enter or leave the cage is termed the forwards/rearwards direction and the vertical direction in which the cage ascends/descends is termed the vertical direction.

Identical items are given the same reference symbols and further description thereof is omitted.

First Embodiment

Figure 1A:
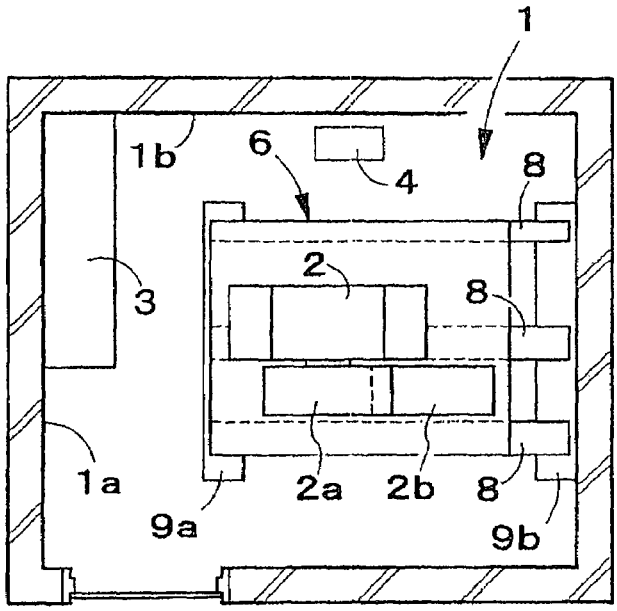
FIG.1A(PRIOR ART)
FIG. 1A is a plan view showing the machinery chamber of a conventional elevator and FIG. 1B is a side cross-sectional view showing the machinery chamber of the conventional elevator.
Figure 1B:
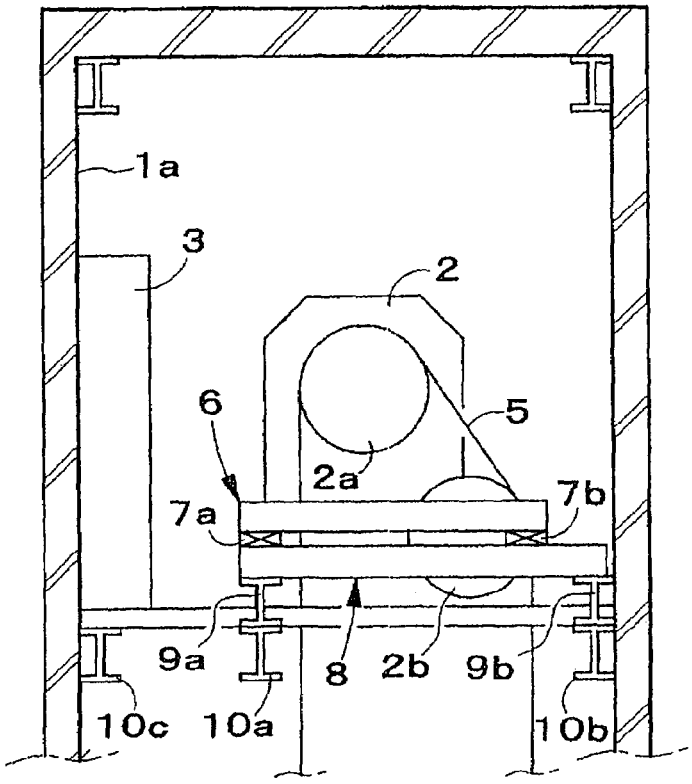
FIG.1B(PRIOR ART)
Figure 2:
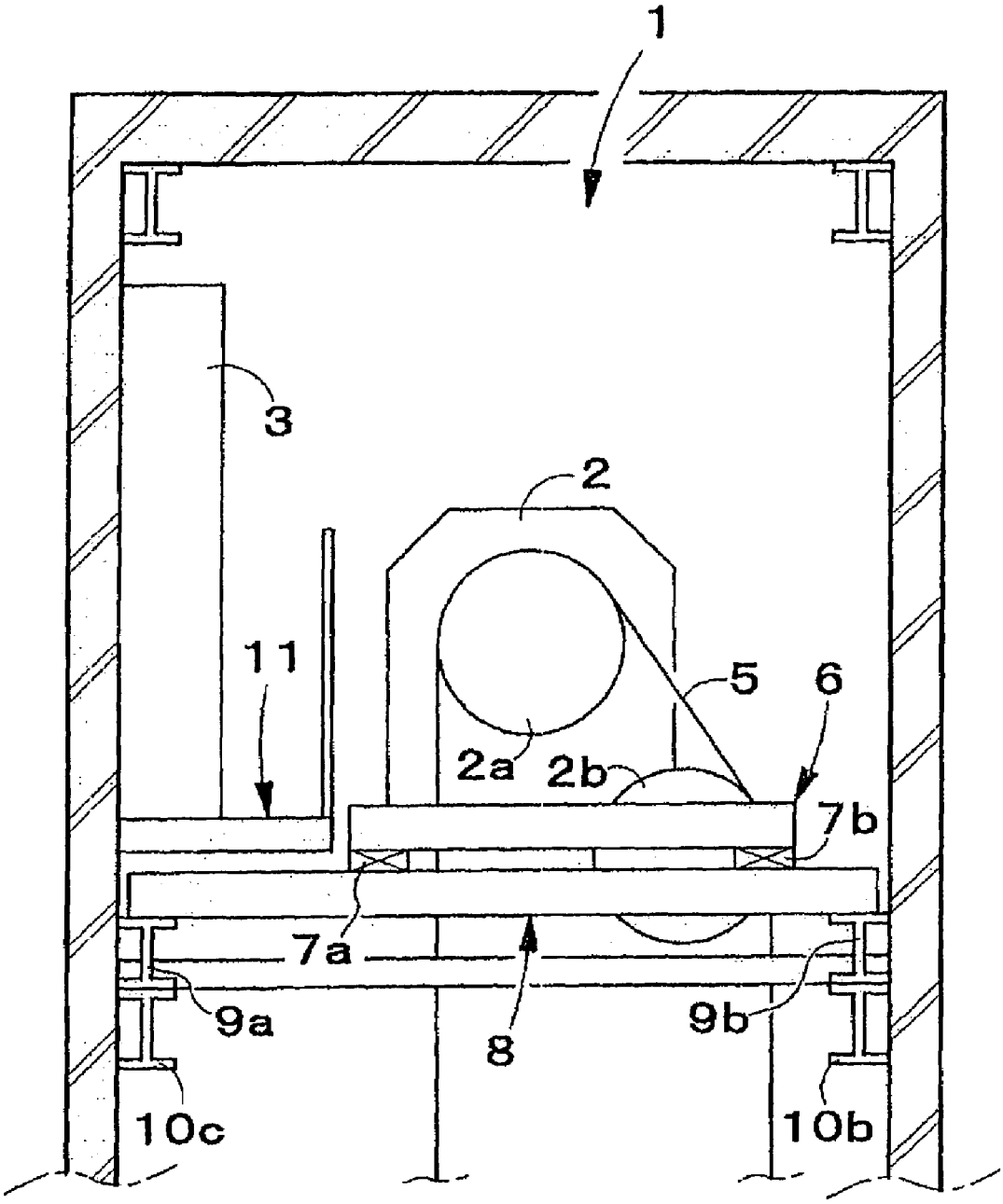
FIG.2(PRIOR ART)
FIG. 2 is a side cross-sectional view showing another machinery chamber of a conventional elevator.
Figure 3:
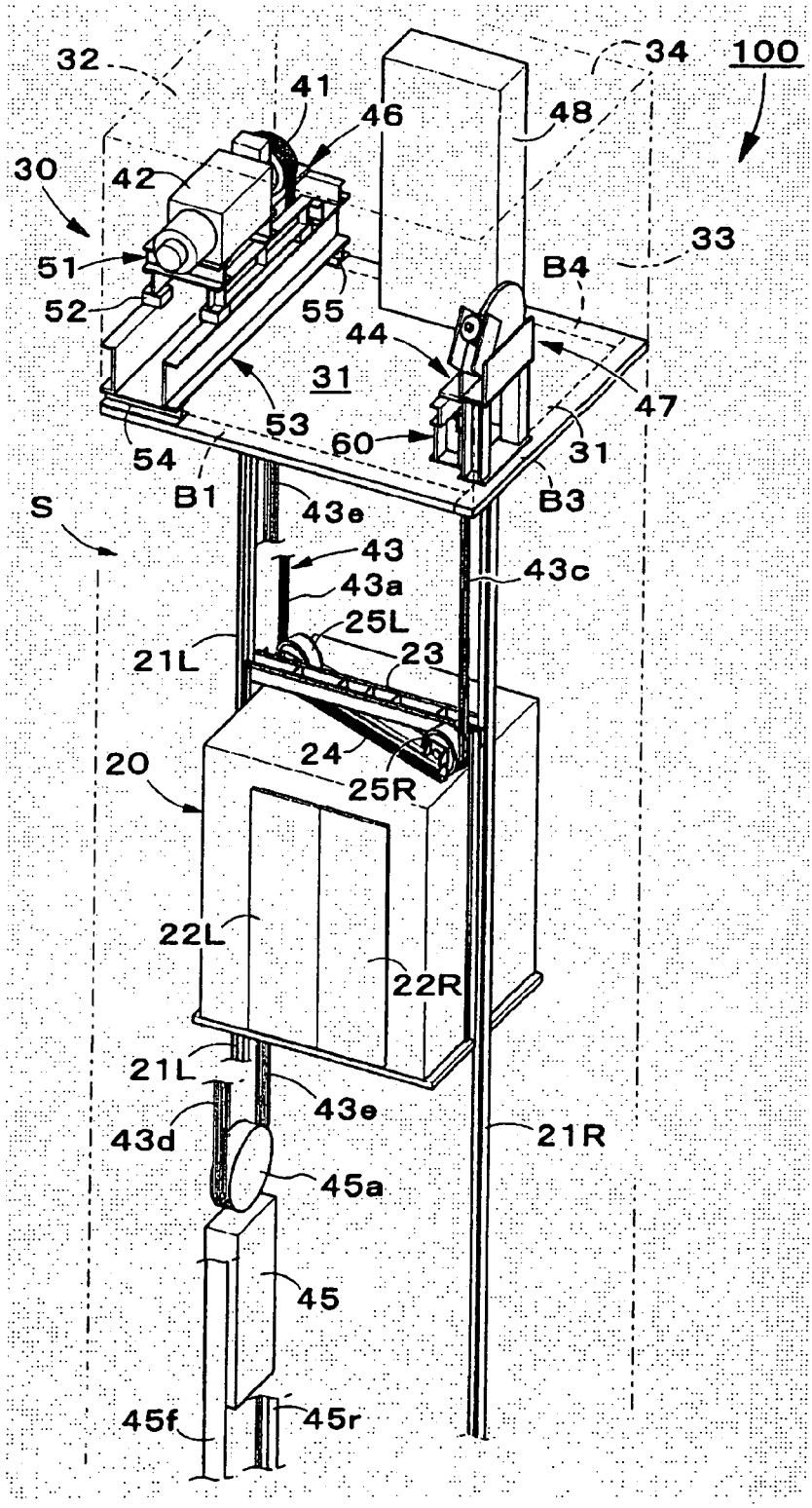
FIG. 3 is a perspective view showing an elevator according to a first embodiment of the present invention.

First of all, the overall construction of an elevator according to a first embodiment will be described with reference to FIG. 3 and FIG. 4. The cage 20 ascends/descends within an elevator shaft S provided in a building, guided by a pair of left and right cage-side guide rails 21L, 21R.

A pair of left and right doors 22 L, 22 R provided in the front face of the cage 20 open and close in the left/right direction.

A cage frame that supports the cage 20 comprises an upper beam 23 that extends horizontally in the left/right direction at the top of the cage 20 and a sheave support beam 24 that extends with its upper surface connected with the upper beam 23 and inclined forward/rearwards and left/right in the horizontal plane with respect to the upper beam 23 so as to tightly adhere to the undersurface of the upper beam 23 in the middle thereof in its longitudinal direction.

Also, a pair of left and right cage-side sheaves 25L, 25R are respectively freely rotatably supported at the left and right ends of the sheave support beam 24.

The machinery chamber 30 is provided at the top of the elevator shaft S, through the interior of which the cage 20 and a counterweight 45 ascend and descend, the counterweight being guided by a pair of front and rear weight-side guide rails 45*f*, 45*r*.

Also, in a region above the left cage-side guide rail 21L on the floor surface 31 of the machinery chamber 30, there are arranged so as to extend along the left inside wall surface 32 a traction sheave 41 that rotates about an axis of rotation extending in the forward/rearwards direction and a drive device 42 having an axis line extending in the forwards/rearwards direction for driving this traction sheave 41 in rotation.

A wire rope 43 wound on the traction sheave 41 comprises a plurality of small-diameter ropes of external diameter 4 to 6 mm and suspends the cage 20 and counterweight 45 in hanging bucket manner with a respective 2:1 roping.

The wire rope 43 comprises a portion 43*a* that depends on the side of the cage 20 from the traction sheave 41, a portion 43*b* that extends horizontally between the pair of left and right cage-side sheaves 25L and 25R and a portion 43*c* that passes through the floor of the machinery chamber 30, extending upwards from the right-side cage-side sheave 25R and whose upper end is abutted by a cage-side stop portion 44 within the machinery chamber 30.

Also, the wire rope 43 comprises a portion 43*d* that depends at the side of the counterweight 45, passing through the floor of the machinery chamber 30 from the traction sheave 41 and a portion 43 that extends upwards after being wound on a weight side sheave 45*a* that is freely rotatably provided on the counterweight 45 and whose upper end is abutted by a weight-side stop portion 46 within the machinery chamber 30 after passing through the floor of the machinery chamber 30.

The stop portion 44 on the cage side and the stop portion 46 on the weight side are defined as wire rope stop portions.

Since the external diameter of the ropes constituting the wire rope 43 is small, at 4 to 6 mm, it is possible to keep the external diameters of each of the traction sheave 41, left and right pair of cage-side sheaves 25L, 25R and weight-side sheave 45*a* to about 200 to 250 mm.

In this way, the degree of freedom of the arrangement of the sheaves is increased, so the degree of freedom regarding arrangement of the wire rope 43 is also increased.

Specifically, the angle of inclination of the sheave support beam 24 with respect to the upper beam 23 can be made small while keeping the pair of left and right cage-side sheaves 25L, 25R sufficiently close to the left and right side walls 20*a*, 20*b* of the cage 20.

In this way, the torsional angle of the portion 43*a* of the wire rope 43 that extends between the traction sheave 41 and the left cage-side sheave 25L can be kept small, so the production of noise or vibration resulting from contact of the ropes constituting the wire rope 43 with the rope grooves of the sheaves can be prevented.

Also, the left cage-side sheave 25L is arranged sufficiently close to the left side wall 20*a* of the cage 20 and part of the traction sheave 41 is arranged so as to the overlap the cage 20 when seen from vertically above and, in addition, the weight-side sheave 45*a* is arranged directly below the traction sheave 41.

In this way, the winding-on angle of the wire rope 43 with respect to the traction sheave 41 can be made 180° or more, so the traction performance can be assured and the pulling-up force can be reliably transmitted from the traction sheave 41 to the wire rope 43.

Next, the layout within the machinery chamber 30 will be described with reference to FIG. 4 to FIG. 6. Of the left and right pair of inside wall surfaces 32, 33 extending facing each other in the forwards/rearwards direction, the traction sheave 41 having an axis extending in the forwards/rearwards direction, drive device 42 and weight-side stop portion 41 are arranged along the left inside wall surface 32.

Also, the cage-side stop portion 44 and speed governor 47 are arranged along the inside wall surface 33.

In addition, the control panel 48 that controls the operation of the drive device 42 etc is arranged along the central part in the left/right direction of the front-face inside wall surface 34 that extends in the left/right direction between the pair of left and right inside wall surfaces 32, 33.

In this way, all in all, a workspace of large dimensions for maintenance and inspection of these items of equipment can be assured in the middle of the floor 31 of the machinery chamber 30.

Figure 4:
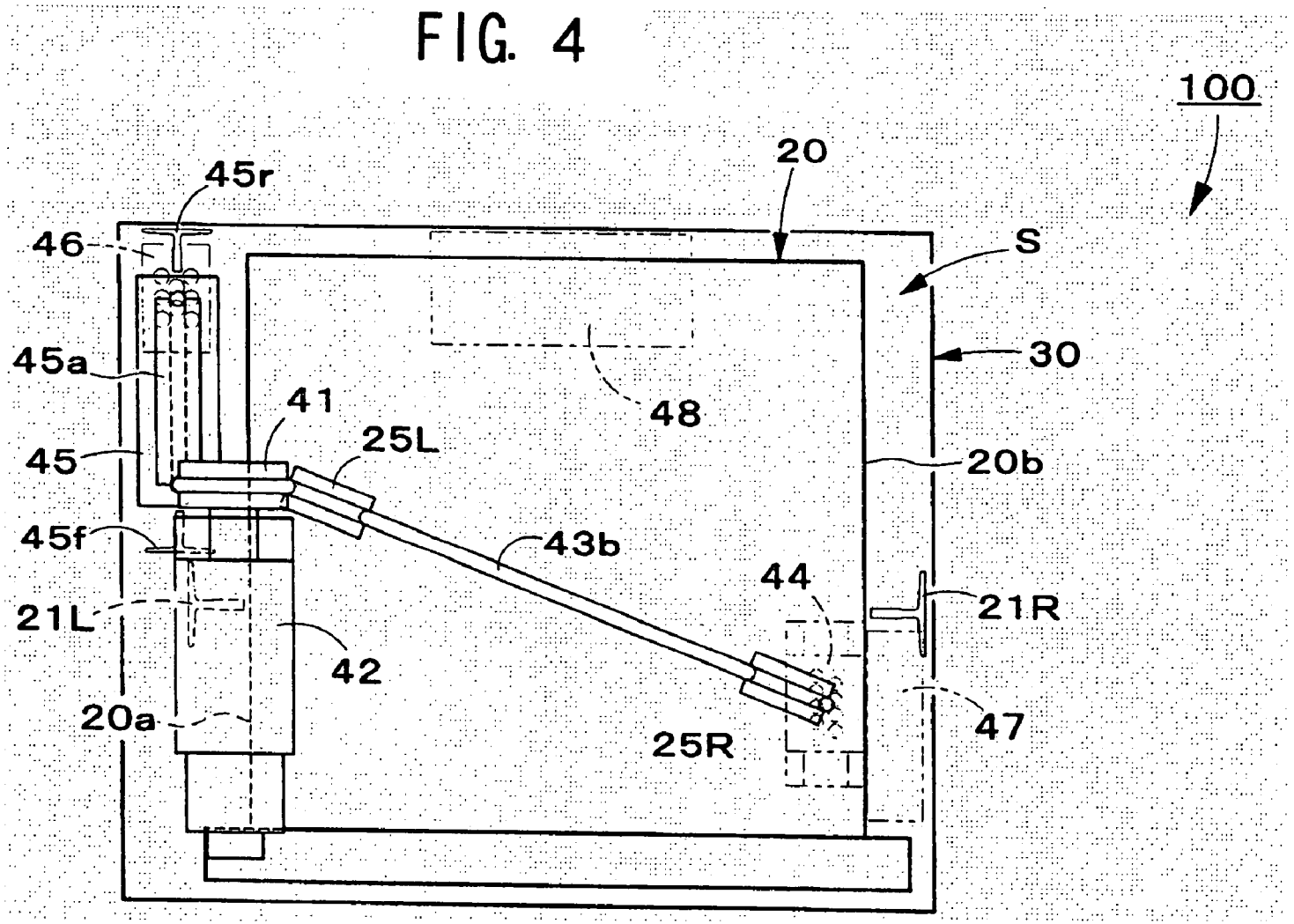
FIG. 4 is a plan view showing diagrammatically the relationship between the elevator shaft and the machinery chamber.
Figure 5:
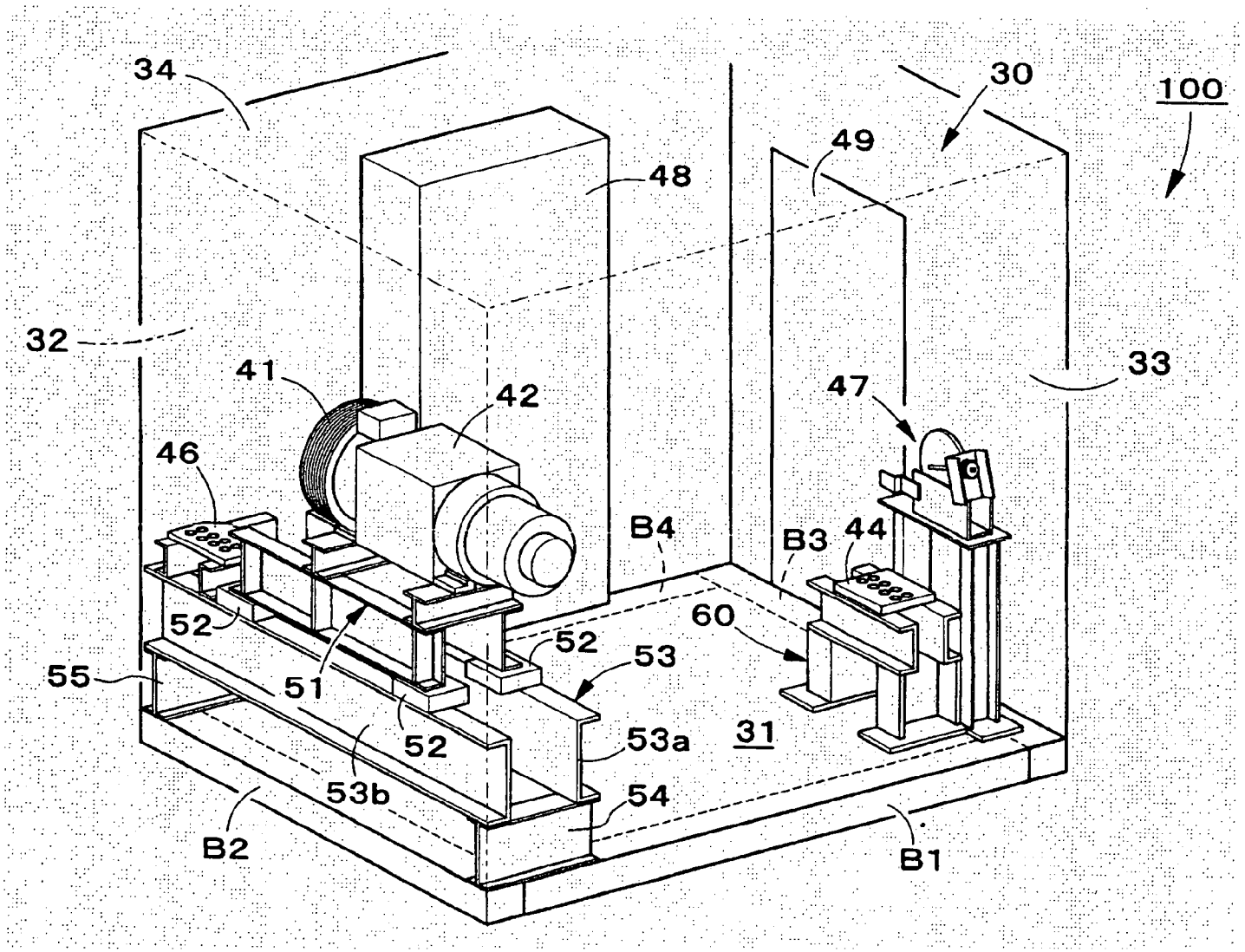
FIG. 5 is a perspective view showing how the equipment is arranged in the machinery chamber shown in FIG. 3.

Specifically, in an elevator 100 according to the first embodiment, as shown in FIG. 4, the traction sheave 41, drive device 42 and weight-side stop portion 46 are provided above the left cage-side guide rail 21L, so these items of equipment can be arranged along the left inside wall surface 32 of the machinery chamber 30.

Also, since the cage 20 is supported by the pair of left and right cage-side sheaves 25L, 25R, the cage-side stop portion 44 can be arranged along the right inside wall surface 33 of the machinery chamber 30.

In addition, since the pair of left and right cage-side sheaves 25L, 25R are arranged close to the left and right side walls 20*a*, 20*b* of the cage 20, respectively, a large interval in the left/right direction can be provided between the traction sheave 41 on the one hand and the drive device 42 and cage-side stop portion 44 on the other.

A workspace of ample dimensions can therefore be assured in the middle of the floor 31 of the machinery chamber 30.

Further, a machine bed 51 that supports the drive device 42 is placed on a machine beam 53 that is constituted by assembling a pair of left and right C-section (C-shaped) steel members 53*a*, 53*b* by means of a total of four anti-vibration rubber elements 52.

The machine beam 53 extends fully in the forwards/rearwards direction within the machinery chamber 30, spanning a pair of front/rear level-raising machine beams 54, 55 that extend in the left/right direction along the front and rear sides of the machinery chamber 30.

In addition, the pair of front/rear level-raising machine beams 54, 55 are placed on a pair of front/rear supporting beams B1, B4 mounted in the building that extend in the left/right direction along the front and rear sides of the machinery chamber 30 and on a supporting beam B2 mounted in the building that extends in the front/rear direction along the left side of the machinery chamber 30.

In the elevator 100 according to this embodiment, there is therefore no need to provide an additional supporting beam in the building for the machine beam 53 that supports the drive device 42.

On the other side, the cage-side stop portion 44 that is arranged along the right inside wall surface 33 of the machinery chamber 30 can be supported by a support frame 60 arranged on the floor 31, if the strength of the floor 31 of the machinery chamber 30 is sufficient.

Also, the speed governor 47 that is arranged along the right inside wall surface 33 adjacent to the cage-side stop portion 44 is provided in a position higher than that of the cage-side stop portion 44, so the maintenance and inspection tasks can be easily conducted.

Figure 6:
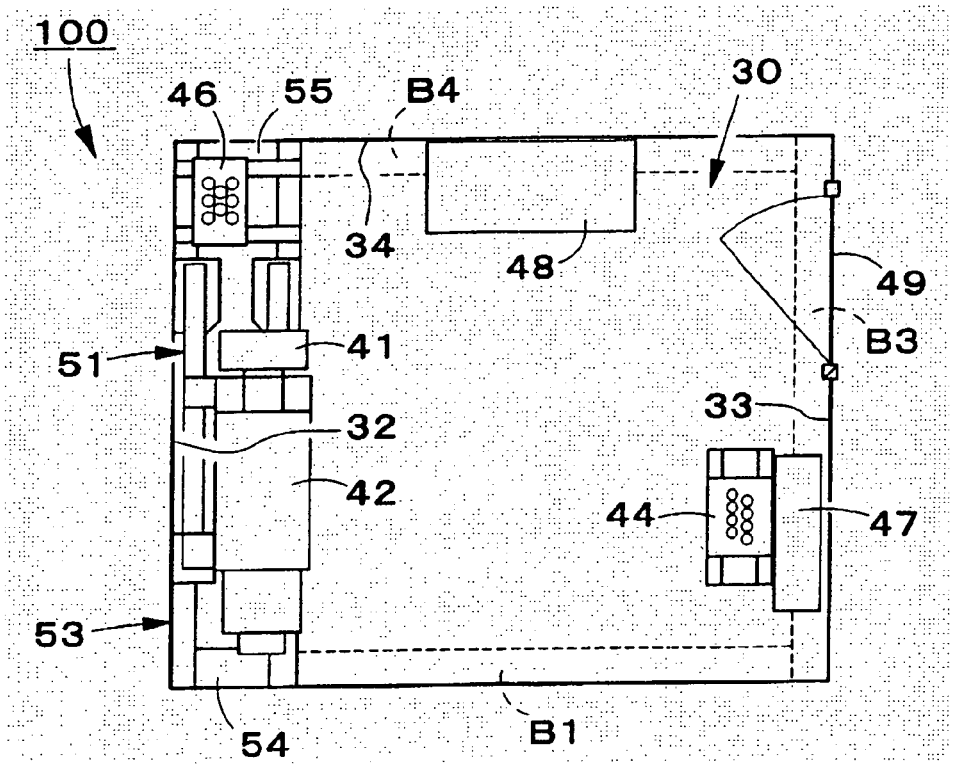
FIG. 6 is a plan view of the machinery chamber shown in FIG. 5.

In addition, the cage-side stop portion 44 and the speed governor 47 are both arranged so as to be separated on the front side from the front-face inside wall surface 34, so a machinery chamber door 47 can be provided in the right inside wall surface 33, as shown in FIG. 6.

Figure 7:
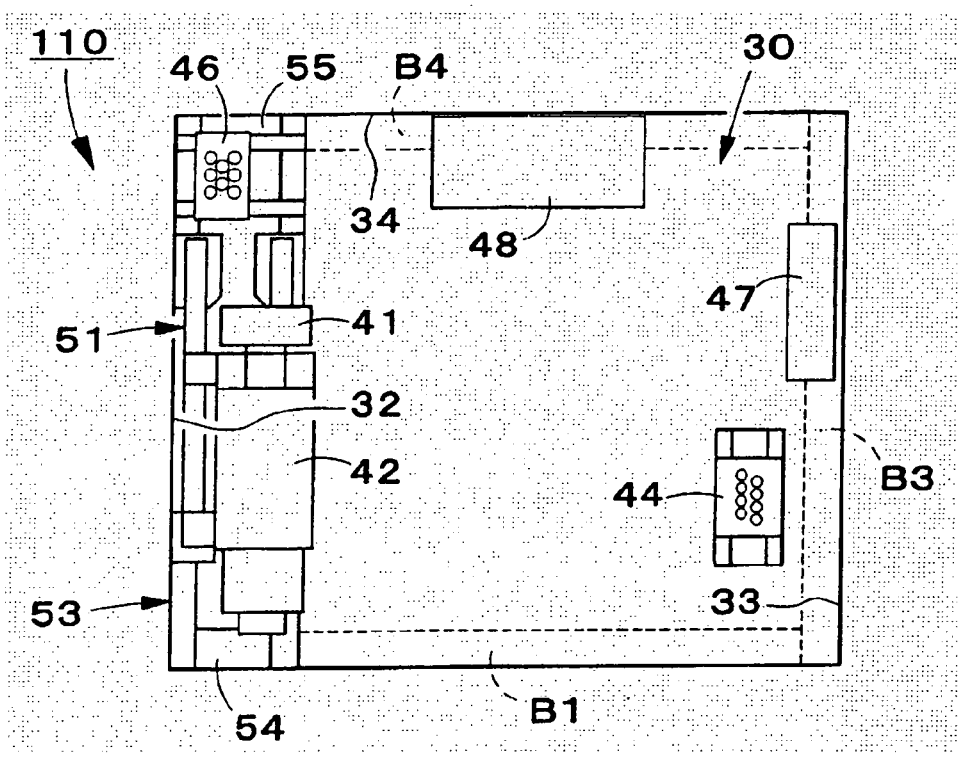
FIG. 7 is a plan view showing a first modified example of the machinery chamber shown in FIG. 6.

It should be noted that, by altering the arrangement of the pair of left and right cage-side sheaves 25L, 25R, it is possible to arrange the speed governor adjacent to the front face of the inside wall surface 34, as in the elevator 110 according to a first modified example shown in FIG. 7.

Figure 8:
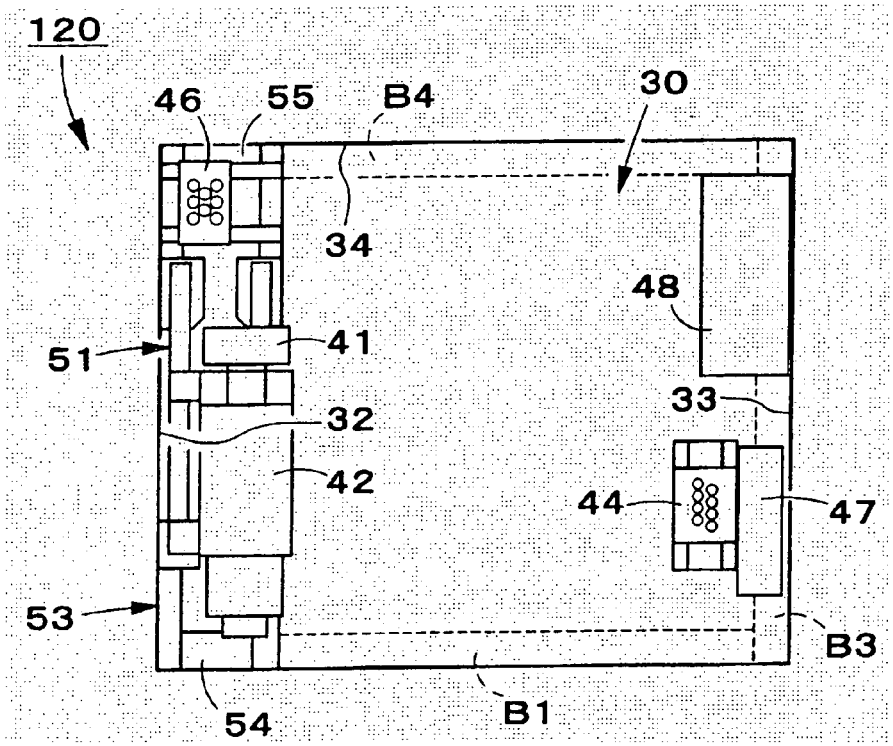
FIG. 8 is a plan view showing a second modified example of the machinery chamber shown in FIG. 6.

In addition, as in the elevator 120 according to a second modified example shown in FIG. 8, it is possible to arrange the control panel 48 along a portion adjacent to the front-face inside wall surface 34 of the right inside wall surface 33, instead of the machinery chamber door 49 in FIG. 6.

Figure 9:
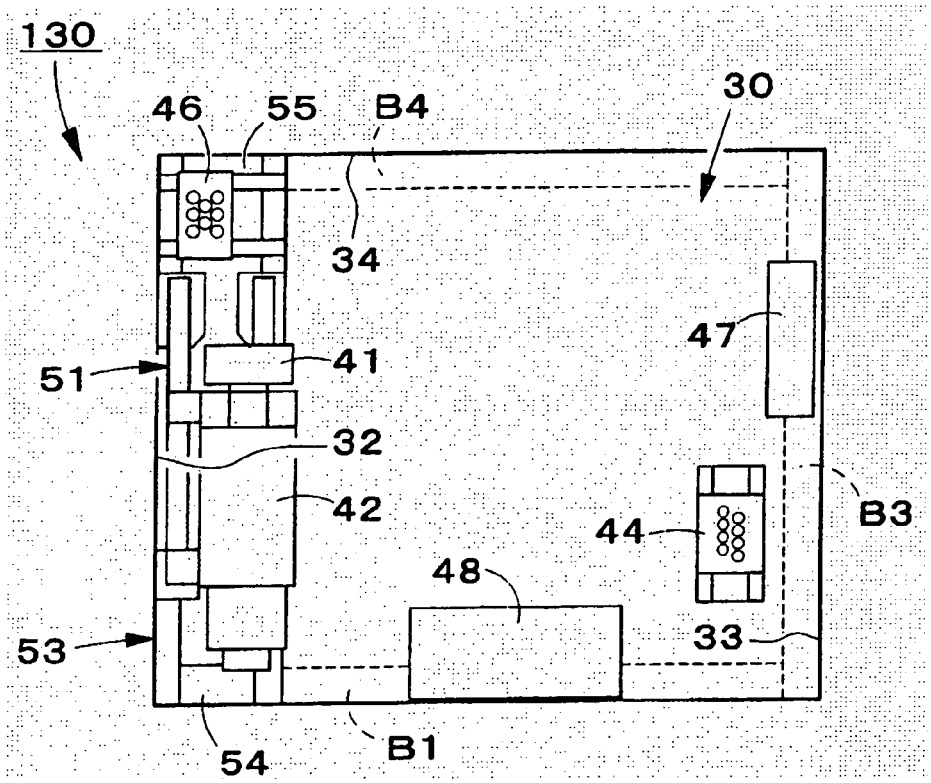
FIG. 9 is a plan view showing a third modified example of the machinery chamber shown in FIG. 6.

In addition, as in the elevator 130 according to a third modified example shown in FIG. 9, it is possible to arrange the control panel 48 along the inside wall surface 25 on the rear face side extending in the left/right direction between the pair of left and right inside wall surfaces 32, 33.

Second Embodiment

Next, an elevator 200 according to a second embodiment will be described with reference to FIG. 10 to FIG. 14.

In the elevator 100 according to the first embodiment described above, the cage-side stop portion 44 was supported by the supporting frame 60 provided on the floor 31 of the machinery chamber 30.

However, for example in cases where sufficient strength of the floor 31 of the machinery chamber 30 cannot be guaranteed or in cases where the cage 20 is of large size and heavy, the cage-side stop portion 44 cannot be directly supported by the floor 31 of the machinery chamber 30.

Figure 10:
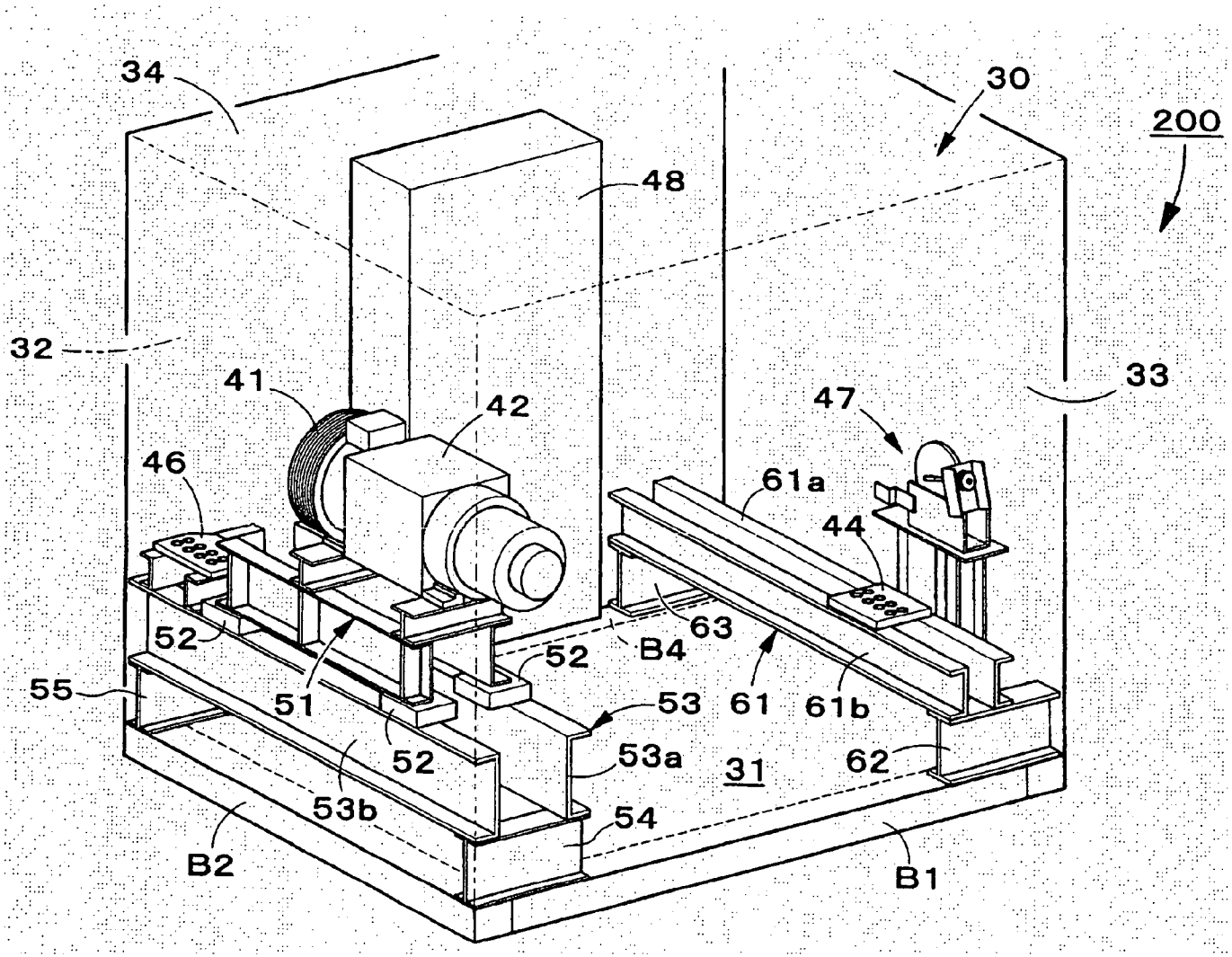
FIG. 10 is a perspective view showing how the equipment is arranged in the machinery chamber according to the second embodiment.
Figure 11:
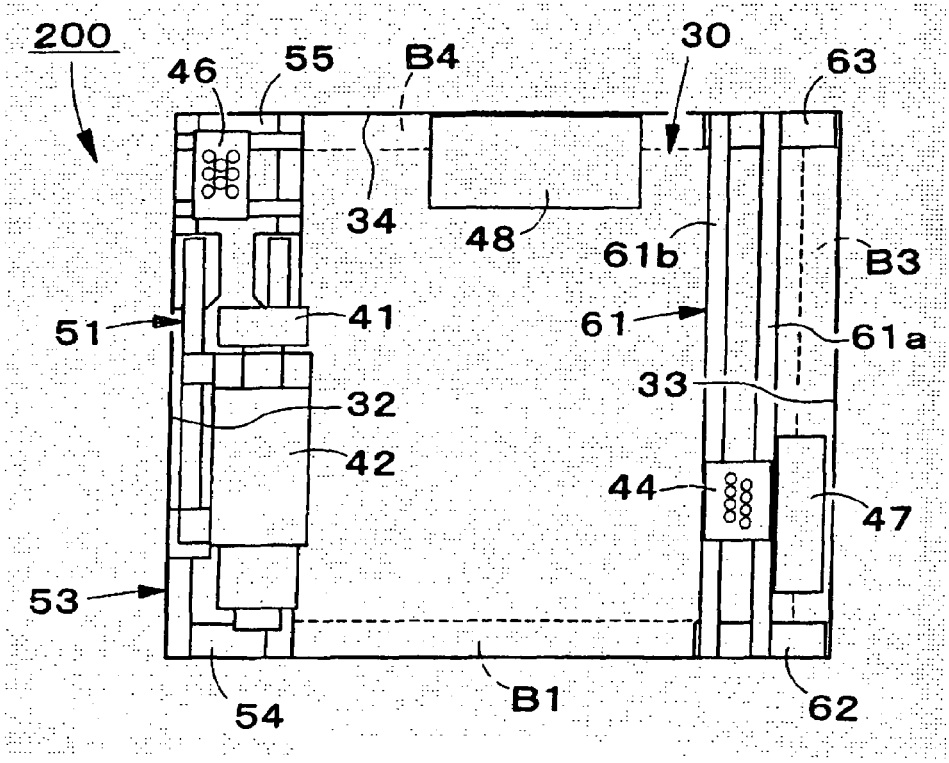
FIG. 11 is a plan view of the machinery chamber shown in FIG. 10.

In such cases, as shown in FIG. 10 and FIG. 11, the cage-side stop portion 44 may be supported by a support beam 61 comprising a pair of left and right C-section (C-shaped) steel members 61*a*, 61*b* extending fully in the forwards/rearwards direction within the machinery chamber 30.

Furthermore, the pair of front and rear level-raising supporting beams 62, 63 are fixed, placed on the pair of front/rear supporting beams B1, B4 mounted in the building that extend in the left/right direction along the front and rear sides of the machinery chamber 30 and that have the front and rear ends of this support beam 61 placed on top of them, and are fixed with the front and rear ends of the support beam 61 placed on these level-raising supporting beams 62, 63.

In this way, the cage-side stop portion 44 can be firmly supported even if sufficient strength of the floor 31 of the machinery chamber 30 cannot be guaranteed, and a wide workspace can be guaranteed in the middle of the floor 31 of the machinery chamber 30.

Figure 12:
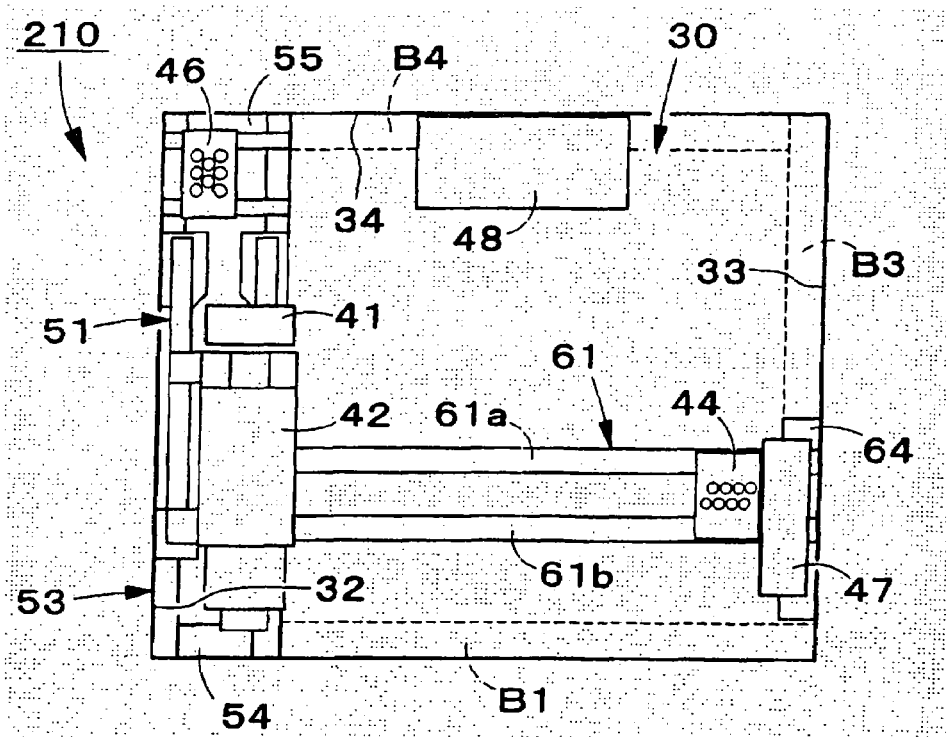
FIG. 12 is a plan view showing a first modified example of the machinery chamber shown in FIG. 11.

It should be noted that, as in the elevator 210 according to a fourth modified example shown in FIG. 12, the support beam 61 that supports the cage-side stop portion 44 could also be arranged so as to extend in the left/right direction within the machinery chamber 30.

In this case, the level-raising support beam 64, on which the right-hand end of the support beam 61 is placed, is fixed placed on a supporting beam B3 fixed in the building that extends in the forward/rearwards direction along the right-hand side of the machinery chamber 30.

The left-hand end of the support beam 61 is connected with the machine beam 53 at the same time.

Figure 13:
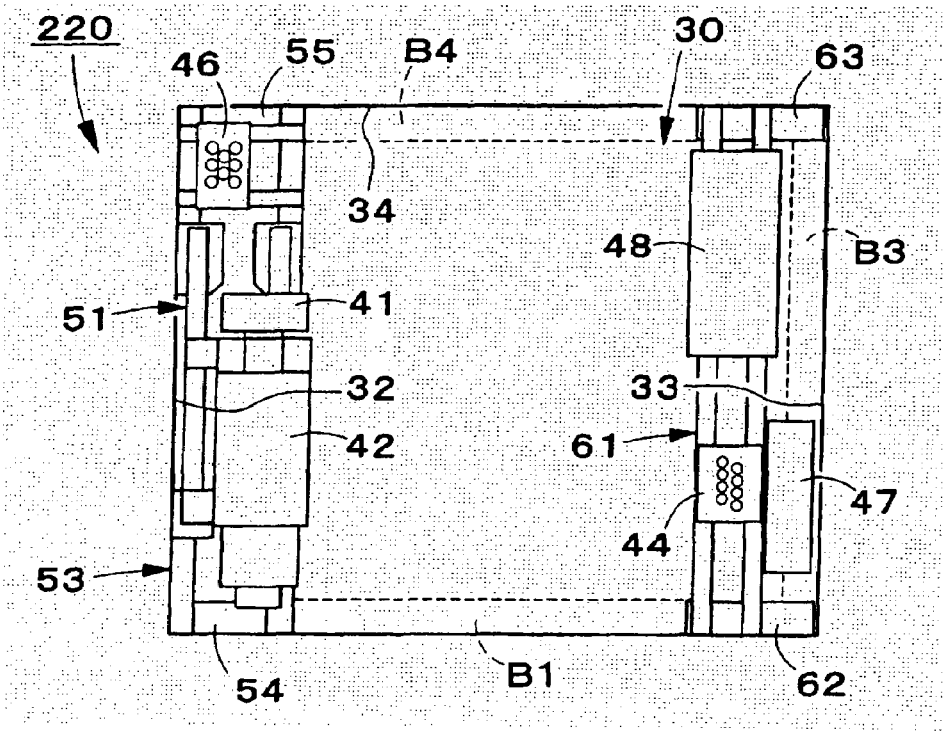
FIG. 13 is a plan view showing a second modified example of the machinery chamber shown in FIG. 11.

Also, the control panel 48 can be placed on the support beam 60 extending in the forward/rearwards direction, as in the elevator 220 according to a fifth modified example shown in FIG. 13.

Figure 14:
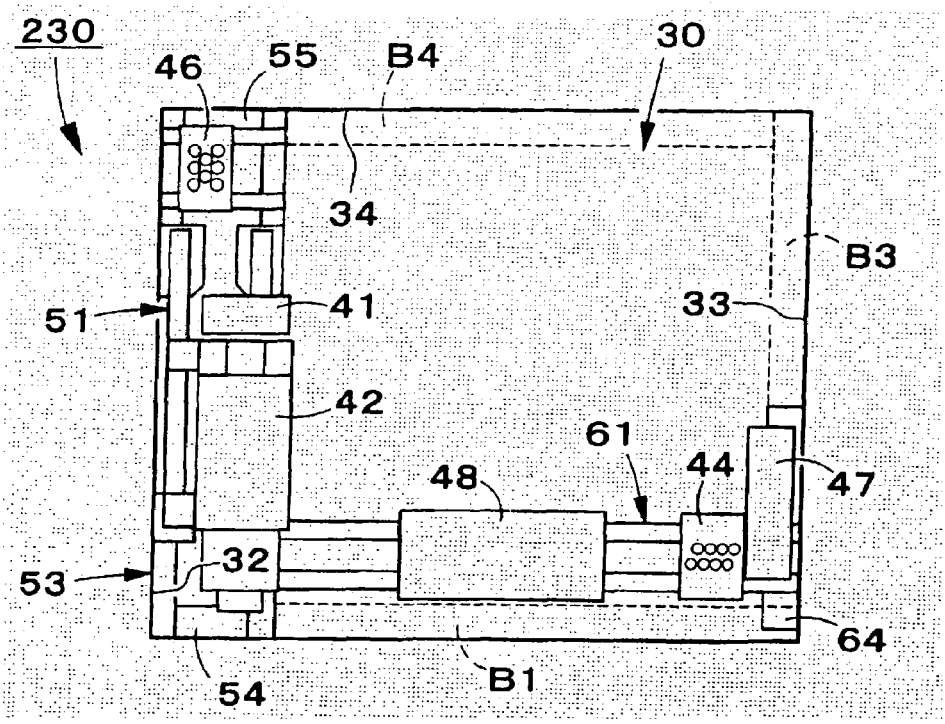
FIG. 14 is a plan view showing a third modified example of the machinery chamber shown in FIG. 11.

In addition, the control panel 48 can be placed on the support beam 61 extending in the forward/rearwards direction, as in the elevator 230 according to a sixth modified example shown in FIG. 14.

While embodiments of an elevator according to the present invention have been described in detail above, the present invention is not restricted to the embodiments described above and could of course be modified in various ways.

For example, although, in the embodiments described above, the cage-side stop portion 44 was arranged at the front side of the right inside wall surface 33 of the machinery chamber 30, the cage-side stop portion 44 could also be arranged at the front side of the right inside wall surface 33 matching the arrangement of the pair of left and right cage-side sheaves 25L, 25R i.e. the cage-side stop portion 44 could be arranged in the vicinity of the front-face inside wall surface 34.

Obviously, numerous additional modifications and variations of the present invention are possible in light of the above teachings. It is therefore to be understood that within the scope of the appended claims, the present invention may be practiced otherwise than as specially described herein.

FIELD OF INDUSTRIAL APPLICATION

As will be clear from the above description, with an elevator according to the present invention, a wide workspace for maintenance and inspection can be guaranteed in the middle of the machinery chamber arranged at the top of the elevator shaft.

Also, since a machine beam extending fully in the forward/rearwards direction in the interior of the machinery chamber can be arranged along either of the left and right inside wall surfaces of the machinery chamber, the machine beam can be supported by supporting beams mounted in the building extending respectively in the left/right direction along the front and rear sides of the machinery chamber, so additional provision of a supporting beam mounted in the building for supporting the machine beam is unnecessary.

What is claimed is:

1. An elevator comprising:

a cage that ascends and descends guided on a pair of left and right cage-side guide rails within a shaft;

a traction sheave that rotates around an axis line of rotation extending in a forwards/rearwards direction and arranged above one of said pair of left and right guide rails on a cage side;

a drive device having an axis line that extends in a forwards/rearwards direction and that drives said traction sheave;

a counterweight that ascends and descends within said shaft while being guided on a pair of front and rear weight-side guide rails below said traction sheave;

a cage-side sheave provided on said cage;

a wire rope wound onto said traction sheave and whereof an end thereof suspends said cage by means of said cage-side sheave and the other end thereof suspends said counterweight; and a machinery chamber provided above said shaft, which comprises:

a machine beam that extends in a forwards/rearwards direction between supporting beams mounted on a building along one inside wall surface of a pair of left and right inside wall surfaces that extend in a forwards/rearwards direction facing each other supports said drive device and said traction sheave and a weight-side stop portion that abuts an end of said wire rope on said counterweight side;

a cage-side stop portion that abuts an end of said wire rope on said cage side;

a speed governor that checks whether said cage is ascending or descending with an appropriate speed within said shaft; and a control panel that controls an operation of said drive device is arranged along an inside wall surface or along the other inside wall surface extending in a left/right direction between said pair of left and right inside wall surfaces.

2. The elevator according to claim 1, wherein said cage-side stop portions and said speed governor are both arranged on a side remote from a front-face inside wall surface, of the other inside wall surface.

3. The elevator according to claim 2, wherein said speed governor is provided above said cage-side stop portion.

4. The elevator according to claim 2, wherein said cage-side stop portion is provided on a support beam that extends in a forwards/rearwards direction between supporting beams mounted on a building, along said other inside wall surface.

5. The elevator according to claim 4, wherein said control panel is arranged in a position that does not interfere with said support beam.

6. The elevator according to claim 4, wherein said control panel is arranged on said support beam.

7. The elevator according to claim 2, wherein said cage-side stop portion is provided on a support beam that extends in a left/right direction from a supporting beam mounted in said building and extending in a forwards/rearwards direction along said other inside wall surface to said machine beam.

8. The elevator according to claim 1, wherein said cage-side stop portion is provided on a support beam that extends in a forwards/rearwards direction between supporting beams mounted on a building, along said other inside wall surface.

9. The elevator according to claim 8, wherein said control panel is arranged in a position that does not interfere with said support beam.

10. The elevator according to claim 8, wherein said control panel is arranged on said support beam.

11. The elevator according to claim 1, wherein said cage-side stop portion is provided on a support beam that extends in a left/right direction from a supporting beam mounted in said building and extending in a forwards/rearwards direction along said other inside wall surface to said machine beam.

12. The elevator according to claim 1, wherein said cage-side sheave is a pair of left and right cage-side sheaves respectively arranged in the vicinity of said left and right side walls of said cage.

13. The elevator according to claim 12, wherein said traction sheave is arranged such that at least a part thereof overlaps with said cage when viewed from vertically above.

14. The elevator according to claim 1, wherein a dimension of said drive device in an axial line direction is larger than its external dimension.

* * * * *